US005937993A

United States Patent [19]

Sheets et al.

[11] Patent Number: 5,937,993

[45] Date of Patent: Aug. 17, 1999

[54] APPARATUS AND METHOD FOR AUTOMATICALLY HANDLING AND HOLDING PANELS NEAR AND AT THE EXACT PLANE OF EXPOSURE

[75] Inventors: Ronald E. Sheets, Santa Ana; Robert Glenn Heitel, Laguna Beach, both of Calif.

[73] Assignee: Tamarac Scientific Co., Inc., Anaheim, Calif.

[21] Appl. No.: 08/783,116

[22] Filed: Jan. 14, 1997

[51] Int. Cl.[6] ..... B25B 11/00

[52] U.S. Cl. ..... 198/345.1; 294/65; 279/3; 269/21; 269/303; 269/305; 269/315; 414/752; 414/941

[58] Field of Search ..... 198/345.1; 294/64.1, 294/65; 269/21, 303, 305, 315; 414/11, 752, 941; 279/3

[56] References Cited

U.S. PATENT DOCUMENTS

| | | | |
|---|---|---|---|
| 2,843,389 | 7/1958 | Sloan et al. | 279/3 |
| 3,934,916 | 1/1976 | Baker | 294/65 |
| 4,684,113 | 8/1987 | Douglas et al. | 269/303 |
| 4,784,377 | 11/1988 | Woodward | 269/21 |
| 5,065,495 | 11/1991 | Narushima et al. | 269/21 |
| 5,352,249 | 10/1994 | Vollaro | 269/305 |
| 5,471,279 | 11/1995 | Takizawa | 269/21 |
| 5,530,516 | 6/1996 | Sheets | 355/53 |
| 5,685,589 | 11/1997 | Kikuchi et al. | 294/65 |

FOREIGN PATENT DOCUMENTS

| | | | |
|---|---|---|---|
| 3316-980 | 11/1984 | Germany | 269/21 |
| 5-299492 | 11/1993 | Japan | 279/3 |

*Primary Examiner*—Janice L. Krizek
*Assistant Examiner*—Douglas Hess
*Attorney, Agent, or Firm*—Oppenheimer Wolff & Donnelly LLP

[57] ABSTRACT

The present invention involves both an apparatus and a method for handling and holding panels and other substrates for photolithographic exposures. In one of its aspects, the present invention comprises bi-modal vacuum cup-bellows devices which automatically retract behind (below) the surface of a chuck, and to remain so retracted at all times except when it is desired to draw a panel toward the chuck. The retraction eliminates interference with movements of the panel during snubbing. In another of its aspects, the present invention comprises registration (locator) pin mechanisms that incorporate bearings. The bearings both turn and move axially, and operate to prevent the panel edges from hanging thereon. In another of its aspects, the present invention comprises a hand-off vacuum cup-bellows device that clamps onto each panel as it comes from a robotic loader. Such device incorporates a lubricious cover that prevents rolling of the cup edges and that facilitates sliding of each panel during snubbing. The devices are such as not to prevent vacuum gripping of the rear surface of the panel. In another of its aspects, the present invention comprises a snubber cylinder and bar that applies light pressure along a substantial length of the thin edge of each panel, and that is constructed to reduce the chances that a panel edge will hang up on the bar.

22 Claims, 6 Drawing Sheets

FIG. 2.
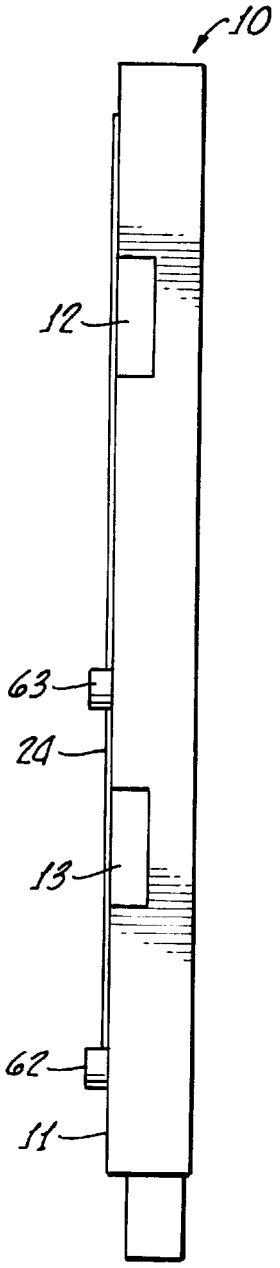
FIG. 4.
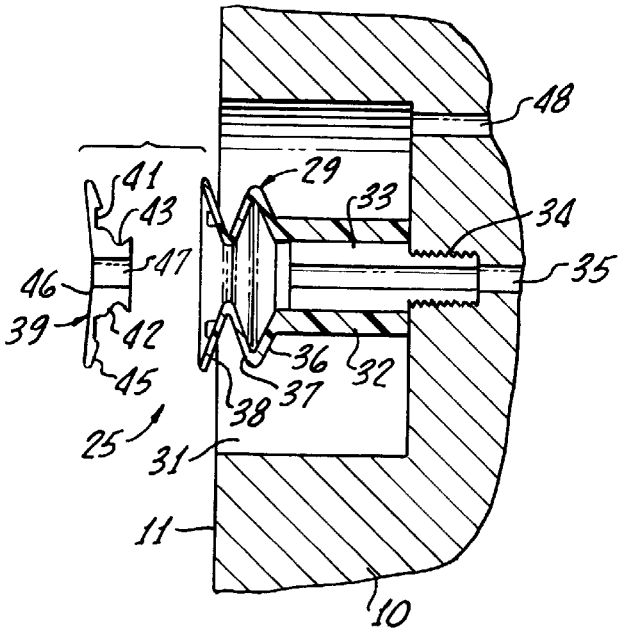
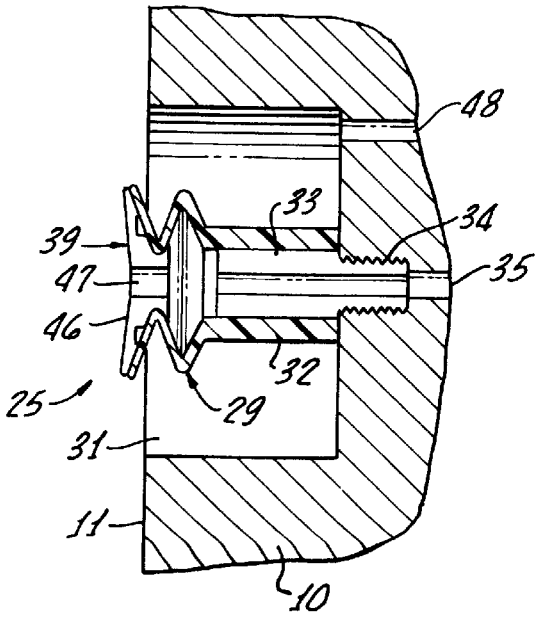
FIG. 4a.

APPARATUS AND METHOD FOR AUTOMATICALLY HANDLING AND HOLDING PANELS NEAR AND AT THE EXACT PLANE OF EXPOSURE

BACKGROUND OF THE INVENTION

Panels used in the multi-chip module and flat panel display industry are thin, the thickness being much the same as that of a microscope slide (a panel thickness is about 0.028 inch to about 0.125 inch, typically). But they are vastly larger than a microscope slide, one size being 400 mm by 400 mm. The substances of which the large thin panels are made may vary, and include glass, metal and circuit-board material.

The panels must be flat during each photolithographic exposure, but in their free (unconstrained) conditions are very seldom flat. Not only are they not flat, but they are irregularly not flat—as distinguished from, for example, bowed. If the panels were not held flat during exposure, the results would be poor resolution, and distortion, etc.

Even if the panels were inherently or initially flat, they very often become warped during processing. The coating of photoresist onto the front sides of the panels, followed by removal of unexposed (or exposed) areas, introduces stresses that cause the warping.

There are major factors, in addition to the thinness and the large sizes of the warped panels, that make it difficult to make them flat and/or to hold them flat. One is that the panels must not be handled from the front, but only from the back. The reason is that there is the photoresist on the front, which must not be scratched and/or disturbed, or so contacted as to cause cross-contamination between panels.

Another of the major factors is that the panels must not only be constrained in flat condition, but so constrained in an exact, precisely-predetermined exposure plane. If this were not so, the photolithographic exposure would not achieve the necessary high-precision results.

Thus, the system must automatically (1) handle the large, thin, warped panels from the back only, and (2) make them locate not only flat but (3) locate in a precisely-predetermined exposure plane.

It may be thought that it would be enough to snub the warped panels against three registration (locator) pins, and then apply a large amount of suction adjacent the flat surface of the chuck having the usual vacuum (suction) grooves. This is not so. It would not be a good thing to suck a major volume of air from behind a warped panel, in an attempt to overcome the big leakages resulting from the warping. To do so would typically require wide vacuum grooves that could bend the panel somewhat into them so that it would not be flat. It would also require large vacuum hoses or tubes, which are undesirable in systems where the chuck is moving. It would also necessitate ignoring the fact that panel edges can hang up on the pins, especially after snubbing.

It is pointed out that in order to expose very large panels the chuck is not only moving but is preferably at a major angle to horizontal. Such an angle provides major benefits, but also tends to increase the degree of warping, and to increase the need for always having full control of the panel so that is does not drop or tip.

Thus, because of the added factors stated in the two preceding paragraphs, additional requirements for a fully satisfactory system include (4) elimination of any necessity for large suction with attendant big grooves and hoses, and (5) provision of effective elements for handling each panel at all times, without ever interfering with desired movements of the panel, and (6) provision of devices for preventing the panels from hanging up on the registration pins.

There are additional factors relative to the achievement of a satisfactory and practical apparatus and method of the present type. One is simplicity, such as results from performing plural functions with simple elements and simple controls.

SUMMARY OF THE INVENTION

The present system (apparatus and method) takes care of (satisfies) all of the above (and other) requirements or factors, in a simple, practical, economical, compact, effective, reliable manner.

In one of its aspects, the system comprises bi-modal vacuum cup-bellows devices that are so constructed and operated as to automatically retract behind (below) the surface of the chuck, and to remain so retracted at all times except when it is desired to draw a warped panel toward the chuck. Because the bi-modal devices are retracted, they cannot interfere with movements of the panel during snubbing. In accordance with the preferred embodiment, the bi-modal devices are retracted and extended by turning on and off the vacuum thereto.

In another of its aspects, the system comprises registration (locator) pin mechanisms that incorporate bearings. The bearings both turn and move axially, and operate to prevent the panel edges from hanging thereon. Extremely high precision is obtained, so that the panel is in the precise desired position for the exposure. The pin mechanisms operate cooperatively with a snubbing cylinder and with the vacuum cup-bellows devices.

In another of its aspects, the system comprises a handoff vacuum cup-bellows device that clamps onto each panel as it comes from a robotic loader. Such device incorporates a lubricious cover that prevents rolling of the cup edges and that facilitates sliding of each panel during snubbing. The devices are such as not to prevent vacuum gripping of the rear surface of the panel.

In another of its aspects, the system comprises a snubber cylinder and bar that applies light pressure along a substantial length of the thin edge of each panel, and that is constructed to reduce the chances that a panel edge will hang up on the bar.

BRIEF DESCRIPTION OF THE DRAWINGS

FIG. 2 is a side elevational view of such apparatus;

FIGS. 4–4*a* are sectional views of the handoff draw-down apparatus, FIG. 4 being partially exploded;

DETAILED DESCRIPTION OF THE PREFERRED EMBODIMENT

U.S. Pat. No. 5,530,516 is hereby incorporated by reference herein. This patent shows and describes a preferred apparatus with which the present system is combined. It is emphasized, however, that the present panel-handling system may be employed in various apparatus other then that in the cited patent.

As an example, the present apparatus is the vacuum chuck that is numbered 51 in the cited patent. Each of the present panels is one form of the substrate that is numbered 32 in the cited patent.

Figure 1:
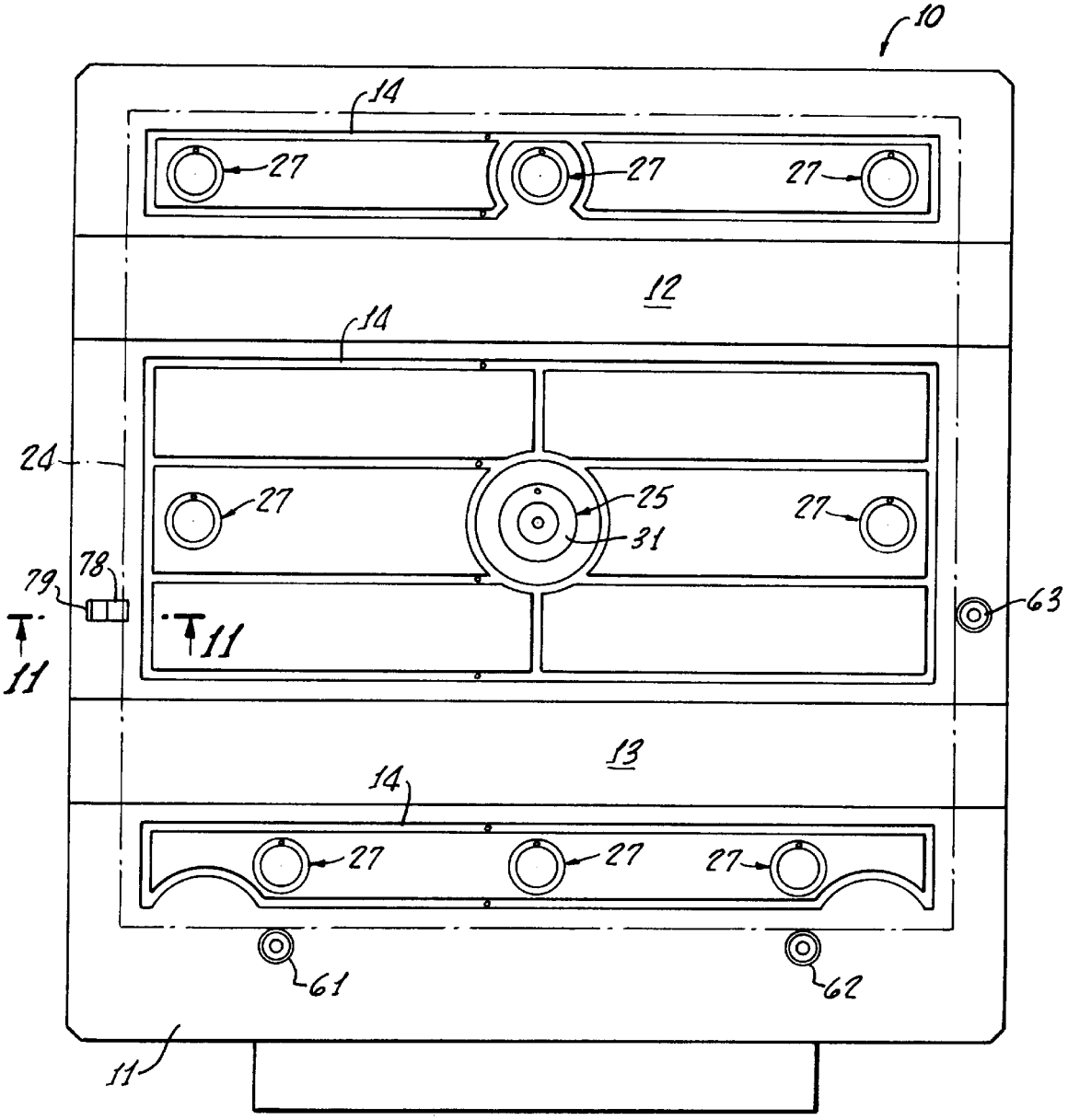
FIG. 1 is a front elevational view showing the face of the vacuum chuck apparatus.
Figure 3:
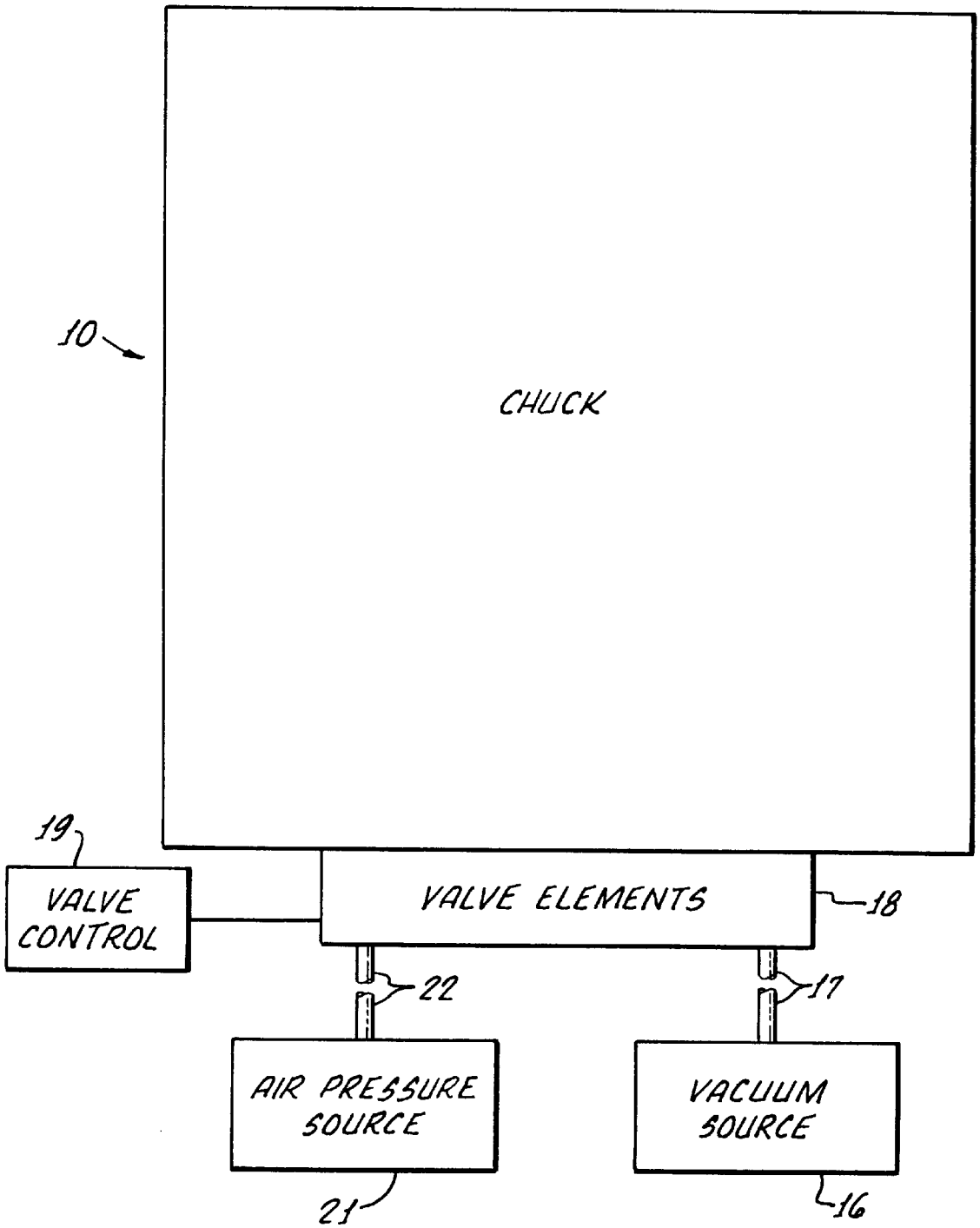
FIG. 3 is a schematic diagram of the vacuum and pressure sources and valves.

Referring to FIGS. 1 and 3, the vacuum chuck is indicated at 10, being a large rectangular element which is shown as being in vertical position. Reference is made to the cited patent for the range of angles at which the chuck 10 should be oriented. Much less preferably, the chuck may be horizontal.

Chuck 10 has a flat, coplanar front surface 11. Provided in spaced relationship in the front surface 11 of chuck 10 are horizontal grooves 12, 13 adapted to receive the end effector that removes the panel (or another substrate) from the chuck surface 11 after the exposure has been completed. The same (or other) end effector places the panel near the chuck.

Vacuum grooves 14 are provided in front surface 11 of chuck 10, at the portions thereof (except at grooves 12, 13) where the panel or other substrate is to be positioned. Vacuum grooves 14 are supplied with vacuum from a vacuum source 16 (FIG. 3) through a flexible vacuum line or conduit 17, through one of the valves in the indicated "valve elements" 18, and through passages (not shown) in chuck 10. This is done at desired times, as determined by a valve control 19 that includes an automatic timer.

It is a feature of the invention that the vacuum source 16 and the flexible line 17, as well as the vacuum grooves 14 and the passages thereto, may be small, namely only as big as is required to hold down the panel or other substrate with the desired force. There is no need for any large rush of air to suck or draw the panel.

The valve elements 18 further includes valves that determine the applications of vacuum to vacuum cup-bellows devices described below, it being understood that there are suitable passages in the chuck 10, and/or suitable hoses or lines, that connect from the valve elements 18 to the respective vacuum devices.

There is also provided an air pressure source 21 (FIG. 3) that supplies air pressure to a flexible line 22 and thus to one of the valves in the valve elements 18. From there the air passes through a suitable line or passage associated with chuck 10, to a below-described air cylinder that is part of the snubber.

Apparatus And Method For Drawing Down The Panels Onto Chuck Surface 11, And For Handling The Panels, And For Preventing Interference With Snubbing Of The Panels Referring to FIGS. 1 and 2, a substrate—such as a panel 24—is shown as mounted on the front surface 11 of vacuum chuck 10. Panel 24 is somewhat less large than such upper surface 11. The panel 24 is, in the present example, the above-indicated one used in the flat panel display industry.

The apparatus comprises a handoff and draw-down (pull-down) apparatus 25, and retractile draw-down (pull-down) apparatus 27. Handoff apparatus 25 is preferably located generally in the central region of chuck 10, while retractile apparatus 27 is preferably located behind (beneath) the peripheral portions of panel 24 at spaced locations. In the illustrated embodiment, there is only one handoff apparatus 25, while there are eight identical retractile draw-down apparatuses 27.

Proceeding first to a description of handoff and draw-down apparatus 25, and referring particularly to FIGS. 4 and 4*a*, this comprises a combination vacuum cup-bellows device 29. The element 29 is mounted in a recess 31 in the front of vacuum chuck 10. The preferred recess 31 is cylindrical and is perpendicular to front surface 11 of the chuck. The combination vacuum cup-bellows 29 is perpendicular to the front chuck surface 11 and (in the illustrated embodiment) is mounted axially of recess 31.

Vacuum cup-bellows device 29 comprises a tubular body 32 that in its preferred form has coaxial cylindrical exterior and interior surfaces. The interior surface of body 32 is pressed onto a hollow cylindrical pin 33, the latter having an end portion 34 that is exteriorly threaded and is screwed into chuck 10 at the inner (bottom) surface of recess 31. Such end portion communicates with a vacuum bore 35 that extends to the above-indicated valve elements 18 (FIG. 3) and thus to line 17 leading to vacuum source 16.

At its outer end, body 32 is integral with an outwardly-divergent frustoconical portion 36, which in turn connects to an outwardly-convergent frustoconical portion 37. Portions 36, 37 are one form of "bellows", it being understood that various other shapes and types of "bellows" (and equivalents) may be employed. Portion 37 connects to an outwardly-divergent frustoconical portion 38 that is a vacuum cup (suction cup).

The described vacuum cup-bellows device formed by elements 36 through 38 and body 32 is made of a suitable soft, resilient, flexible synthetic resin or rubber, etc. It is commercially available, for example under part number PNG-130-AS, manufactured by Myotoku Ltd., which is located at Tokyo, Japan. The outer diameter of each vacuum cup portion is 20 mm. The depth of recess 31, the size of vacuum cup-bellows 29, etc., are caused to be such that in its normal, free condition (no vacuum applied and/or no panel present) the outer or forward end of such vacuum cup-bellows is substantially above flat surface 11—meaning that such end is substantially forward (to the left in FIGS. 4 and 4*a*) of flat surface 11. The distance by which the outer end of vacuum cup-bellows/cup 29 extends out of recess 31 is so selected that such outer end is able to engage and clamp against the back (rear) surface of the panel 24 or other substrate being handled, despite the warped condition of the substrate. The indicated outer portion 38 is so thin and soft that it tends strongly to roll when panel 24 slides thereover. To prevent such rolling, to prevent wear, and to reduce friction so as to lessen the force required to cause lateral movement of the panel 24, a cover element 39 is provided as shown as FIGS. 4 and 4*a*.

Cover element 39 is not formed of a soft rubber or soft synthetic, but is instead hard and lubricious. It may be injection-molded, for example of Delrin, Teflon, or polypropylene.

Cover element 39 comprises a disk-shaped working portion 46 that is coaxial with a thick rigid base 42. At its region relatively removed from portion 41, base 42 is shaped with an annular groove 43 that is dimensioned to receive the junction region between portions 37, 38 of vacuum cup-bellows 29. Thus, cover 39 is connected to the vacuum cup-bellows (and forms a part thereof) by inserting (popping) the inner end of base 42 into the vacuum cup-bellows to the position shown in FIG. 4*a*.

When the cover is in the position of FIG. 4*a*, a somewhat frustoconical surface 45 (FIG. 4) thereof seats on the outer peripheral region of cup portion 38, having an outer diameter similar to that of such peripheral region.

The portion of the cover 39 between surface 45 and base 42 is angularly grooved at 41 to receive angularly spaced protuberances formed on cup portion 38.

The outer surface of cover element 39, numbered 46, is slightly dished. Thus, when the peripheral region of cover 39 engages the inner side of panel 24, a vacuum is drawn between surface 46 and the opposed panel surface. This causes the cover 39, and thus the vacuum cup-bellows, to clamp onto the panel surface. This occurs despite the fact that cover 39 is not the usual soft, pliant suction-cup material, but instead is hard.

There is a bore 47 formed axially in base 42. Such bore 47 is large in diameter, at least as large as the diameter of the passage through pin 33 and the passage 35 through chuck 10. Accordingly, unless a panel is present, the pressure within the vacuum cup-bellows below cover 39 will be at least substantially as large as the ambient pressure outside the cover 39. Therefore, the vacuum cup-bellows is not retracted when vacuum is applied to it, except under the condition next stated.

When a panel is adjacent the dished surface 46 of the cover, the space between the panel and surface 46 becomes somewhat evacuated, as does the space within the bellows. Accordingly, the pressure differential will cause the bellows to collapse and pull or draw the panel portion (that is near apparatus 25) to a position seated on chuck surface 11.

There is a vent bore 48 in chuck 10, extending between recess 31 and the side of the chuck remote from surface 11, so as to prevent vacuum from building up in recess 31. The only desired vacuum is within the vacuum cup-bellows, and then only when a panel is present adjacent dished surface 46. When vacuum is no longer applied to bore 35 and thus to the interior of the vacuum cup-bellows, the pressure within the bellows returns to atmospheric, and the panel is released.

It is emphasized that the composition and hardness of cover 39 are such as to minimize friction between the vacuum cup-bellows and panel, while simultaneously preventing rolling of the peripheral edge of the frustoconical portion 38. Therefore, especially after the vacuum is released, only a relatively small force need be applied to the edge of the panel in order to slide the panel to a desired location during the below-described snubbing.

Proceeding next to a description of the retractile draw-down (pull-down) apparatuses 27, each of the eight elements 27 shown in FIG. 1 is identical to each of the other, so only one is described in detail. Such one is shown in four different conditions, in FIGS. 5–8.

Each apparatus 27 comprises a recess 31*a* corresponding to the above-described recess 31, except that it preferably has a smaller diameter. It further comprises a combination vacuum cup-bellows 29*a* that is preferably identical to the above-described vacuum cup-bellows 29. Element 29*a* is mounted on a hollow cylindrical pin 33*a* that corresponds to the above-described pin 33, and that communicates with a vacuum bore 51 in chuck 10. Bore 51 is connected to one of the valves in valves elements 18 (FIG. 3)—namely a different valve element than the one with which the handoff apparatus 25 communicates.

There is mounted in vacuum cup-bellow 29*a* an orifice disk 54. The preferred manner of mounting is to provide a peripheral groove in such disk 54 and pop the disk into the illustrated position, at which an inner-diameter portion of the bellows is disposed in such peripheral groove.

Orifice disk 54 has provided therein an orifice or bore 55 that is much smaller than the passage 56 through pin 33*a*, or the passage 51 through chuck 10.

Figure 5:
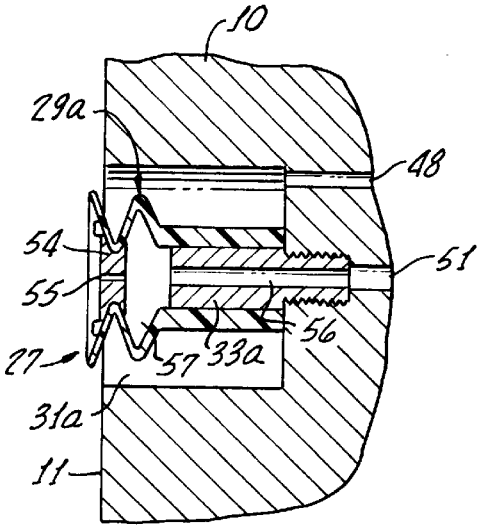
FIGS. 5–8 are sectional views of the retractile draw-down apparatus, under different conditions.

When no vacuum is applied to vacuum cup-bellows 29*a*, the natural resilience of the vacuum cup-bellows causes the outer (rim) portion thereof to be substantially above outer (front) surface 11 of the chuck, as shown in FIG. 5.

Figure 6:
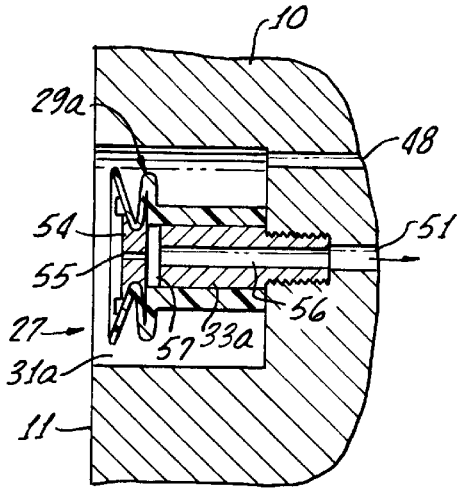

When, however, vacuum is applied to bore 51 and thus to passage 56 and to the chamber 57 within the vacuum cup-bellows, the vacuum cup-bellows collapses to the position (condition) shown in FIG. 6. This is (as above indicated) because the orifice 55 is caused to be so small that the amount of ambient air that passes inwardly through it is insufficient to satisfy the applied vacuum. Accordingly, the pressure in chamber 57 reduces, so that the ambient air forces the vacuum cup-bellows to the collapsed position illustrated in FIG. 6.

The size relationships are caused to be such that when the vacuum cup-bellows is thus collapsed, the outer (rim) portion thereof is below (inwardly of) the plane of front or outer surface 11 of vacuum chuck 10. This being so, when the illustrated (and the seven other) retractile elements 27 are in the position of FIG. 6, there is no way that any movement of the panel 24 or other substrate can be affected. The panel cannot be contacted by the fully collapsed vacuum cup-bellows devices, and cannot be impeded by them.

It is emphasized that each vacuum cup-bellows maintains its collapsed condition of FIG. 6 even after a panel or other substrate is mounted adjacent surface 11. There is caused to be a space between the panel and the outer end of the collapsed vacuum cup-bellows. Thus, the panel does not prevent flow of air to the region above (to the left in FIG. 6) the outer end of the vacuum cup-bellows, such air coming into the recess 31*a* via vent bore 48. The vent bore is so large in diameter that the pressure in recess 31*a*, including that portion thereof above (outwardly of) the vacuum cup-bellows, is sufficiently large to maintain the vacuum cup-bellows in the collapsed condition of FIG. 6 so long as the vacuum is applied through bore 51, and provided that the collapsing occurred before the panel was present.

The preceding paragraph relates to the extreme case where a recess 31*a* is blocked (substantially sealed) by a panel. Very frequently, the warped condition at the panel prevents such blocking, so that air flows directly into the mouth of the recess.

Figure 7:
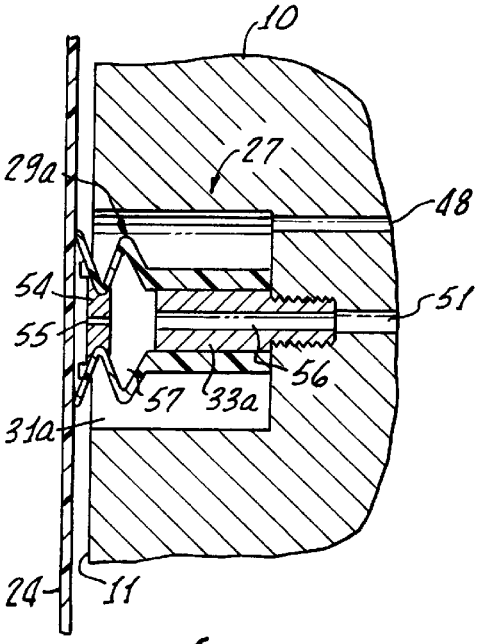

Referring next to FIG. 7, the condition is illustrated where the application of vacuum to passage 51 is terminated, and ambient air is permitted to enter such passage. The vacuum cup-bellows then expands to the illustrated condition, due to its own resilience, and contacts the inner surface of the adjacent panel portion (assuming a panel is present). This happens even though the panel is warped—not engaged flat against surface 11.

Figure 8:
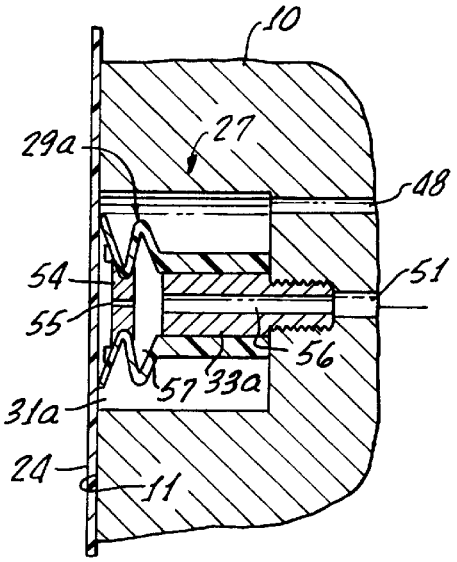

Referring next to FIG. 8, the condition is illustrated where vacuum is applied to bore 51 and thus to chamber 57 after the vacuum cup-bellows has expanded into engagement with the panel. The outer peripheral region of the vacuum cup-bellows then clamps onto the underside of the panel 24 (this being the right side of FIGS. 7 and 8). This occurs because there is sufficient flow of air through orifice 55 into chamber 57, from the space between orifice disk 54 and panel 24, to reduce the pressure in such space to the extent that a vacuum-cup action occurs relative to the panel, and the clamping-on happens.

Not only does the applied vacuum cause the cup portion to clamp onto the underside of panel 24, but it also reduces the pressure in chamber 57 to thereby cause partial collapse of the vacuum cup-bellows to the condition of FIG. 8. The collapse occurs to the extent permitted by the fact that the outer peripheral region of the vacuum cup-bellows remains clamped onto the underside of the panel. The panel portion near each apparatus 27 is thus pulled against surface 11, and held there until the vacuum to apparatus 27 is released. By that time, however, the vacuum grooves 14 have taken over.

If desired, the cover element 39 described relative to FIGS. 4 and 4*a* may be employed also on the vacuum cup-bellows of FIGS. 5 through 8. In such event, however, the bore 47 (FIGS. 4 and 4*a*) is caused to be much smaller in diameter, as discussed relative to orifice 55.

DESCRIPTION OF APPARATUS AND METHOD FOR POSITIONING THE PANEL OR OTHER SUBSTRATE AND PREVENTING IT FROM HANGING UP

There are three registration (locator) pin devices, numbered 61, 62 and 63 and FIG. 1. Each is identical to the others, so only one is described and with particular reference to FIGS. 9 and 10.

Two of the pin devices, numbers 61 and 62, are provided at the lower portion of chuck 10 in spaced relationship from each other, and at the same elevation. They support the lower horizontal edge of panel 24, and determine the position of panel 24 in a vertical direction.

The remaining registration pin device, number 63, is provided at the right side of chuck 10 in spaced relationship above devices 61, 62, and determines the horizontal position of the panel 24.

The panel 24 is lowered onto devices 61, 62 and then snubbed against device 63, both the horizontal and vertical positions of panel 24 are very accurately determined.

In accordance with one aspect of the present invention, the frictional force between pin devices 61–63 and the edges of panel 24 or other substrate is reduced or eliminated. Furthermore, the reduction or elimination is in two directions, namely parallel to chuck surface 11 and perpendicular thereto.

Figure 10:
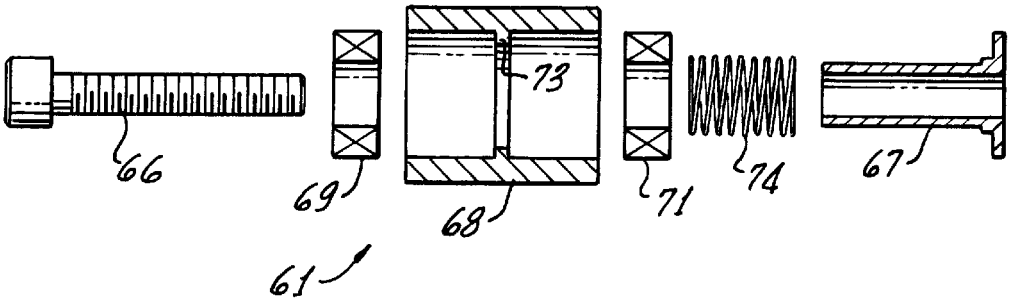
FIG. 10 is an exploded view thereof.
Figure 9:
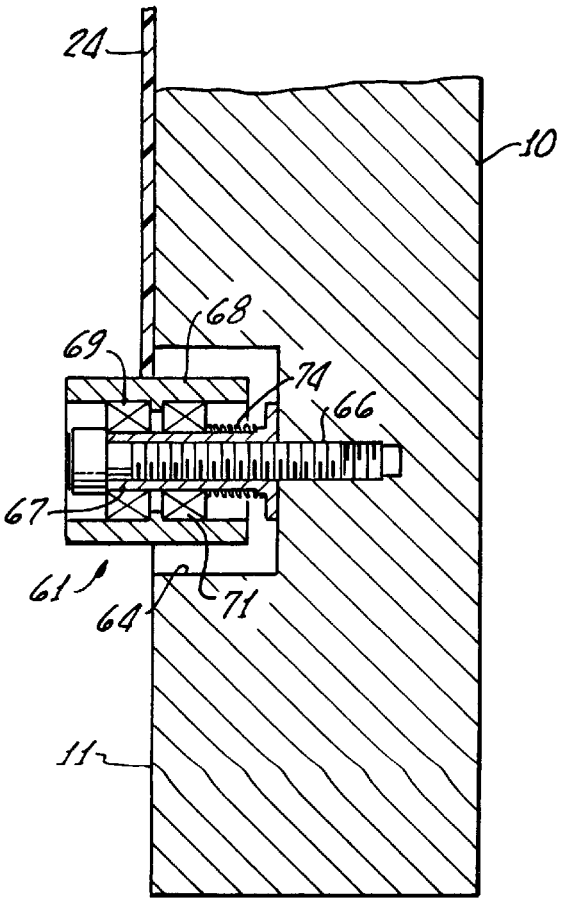
FIG. 9 is a vertical sectional view of a registration pin device.

Referring to FIGS. 9 and 10, a recess 64 is formed in chuck 10 and is sufficiently large in diameter to prevent any rubbing action. A cap screw 66 (a shaft) is threaded into an internally threaded bore in chuck 10, perpendicularly to the front surface 11 of the chuck. Mounted coaxially around screw 66 is a hardened bobbin 67 for the below-described bearings and also for a spring.

An abrasion-resistant sleeve 68 is rotatably mounted around bobbin 67 in radially-spaced coaxial relationship relative thereto, being held in position by first and second precision bearings 69, 71. The bearings seat within sleeve 68 against opposite faces of an interior flange 73. A light helical compression spring 74 is mounted coaxially around bobbin 67, extending between the base of the bobbin and the inner face of inner bearing 71.

The relationships are caused to be such that sleeve 68 rotates with very low friction. Furthermore, sleeve 68 is held in its forwardmost position (to the left in FIG. 9) by the light spring 74. Such spring 74 is so light that it is only barely strong enough to maintain sleeve 68 in its forward or outer position at all times except when a force is brought to bear on the exterior surface of sleeve 68. Such force, caused by panel or other substrate 24, as described below, urges the sleeve 68 inwardly toward the bottom of recess 64.

Because sleeve 68 extends into recess 64 there is no possibility that the lower edge of panel 24 will get back of the sleeve. Also, sleeve 68 is sufficiently long that it accommodates all edge positions of even the warped panels 24. The bottom panel edge does not move downwardly past sleeve 68, but instead engages it in tangential manner.

When panel 24 is dropped down onto pin devices 61, 62 and then shifted to the right (FIG. 1) by the snubbing mechanism next described, the sleeves 68 of devices 61, 62 rotate freely so that the panel travels over the surfaces of devices 61, 62 without there being any abrasion of the sleeves 68 or of the lower panel edge. The same occurs relative to pin device 63 in the event the sleeve 68 thereof is engaged by the right edge of panel 24 (FIG. 1) while the panel is being lowered onto devices 61, 62.

After panel 24 is in the precise desired horizontal/vertical position, it is pulled back onto flat surface 11 by the above-described operation of the retractile draw-down apparatuses 27. This is done easily, with no substantial hanging up of panel edges on pin devices 61–63 because the sleeves 68 move toward the chuck with the panel edges.

Later in the cycle, when panel 24 is removed, the sleeves 68 move outwardly to their initial positions in response to outward forces created by springs 74.

Proceeding next to a description of the snubbing device, vacuum chuck 10 has a groove or slot 78 in which a snub bar 79 is mounted. Bar 79 is connected by a screw 80 to the piston of an air cylinder 81, operated by air pressure.

A portion of snub bar 79, located outwardly of the left edge (FIG. 1) of panel or other substrate 24, has an inner face 83 that is not perpendicular to the chuck but instead is inclined downwardly and outwardly. Accordingly, when such face 83 engages the left edge (FIG. 1) of panel 24, there is only a small tendency for the panel to hang up on the face. Stated otherwise, the inclination of face 83 causes it to engage only a limited part of the panel edge, at or near the outer surface thereof, so that face 83 does not create an excessive force attempting to prevent the panel 24 from being pulled toward the chuck by the retractile draw-down apparatuses 27.

In accordance with the best mode of the present invention, there is additionally provided on face 83 a movable slide plate (not shown) that is biased outwardly by a light spring. Such slide plate is inclined substantially the same as the incline indicated relative to face 83. When the face of the slide plate engages the panel edge in response to operation of cylinder 81, if there is any force causing the edge to hang up, the slide plate moves toward the chuck—against the bias of the spring. When the face no longer engages the edge of the panel, the spring moves the slide plate back to its original position.

Further Description Of The Apparatus And Method, Particularly Includinq The Timing And Sequence Of Operation Of The Various Elements Of The System Each of the valves in the valve elements box 18 (FIG. 3) is a two position valve. The valves that determine the application of vacuum from source 16 to the vacuum cup-bellows devices each have one position that causes vacuum to be applied. Each also has a second position that permits ambient air to enter into the lines and thus into the vacuum cup-bellows devices. Similarly, the valve in the valve elements box 18 that controls the supply of air pressure to the air cylinder 81 (FIG. 11) that operates snub bar 79 has one position that supplies air to cylinder 81 and thus causes the face 83 of the bar 79 to be moved against the edge of panel 24. It also has a second position that vents the air from cylinder 81, and permits a return spring (not shown) to shift bar 79 and its face 83 back to the position illustrated in FIG. 11.

Figure 12:
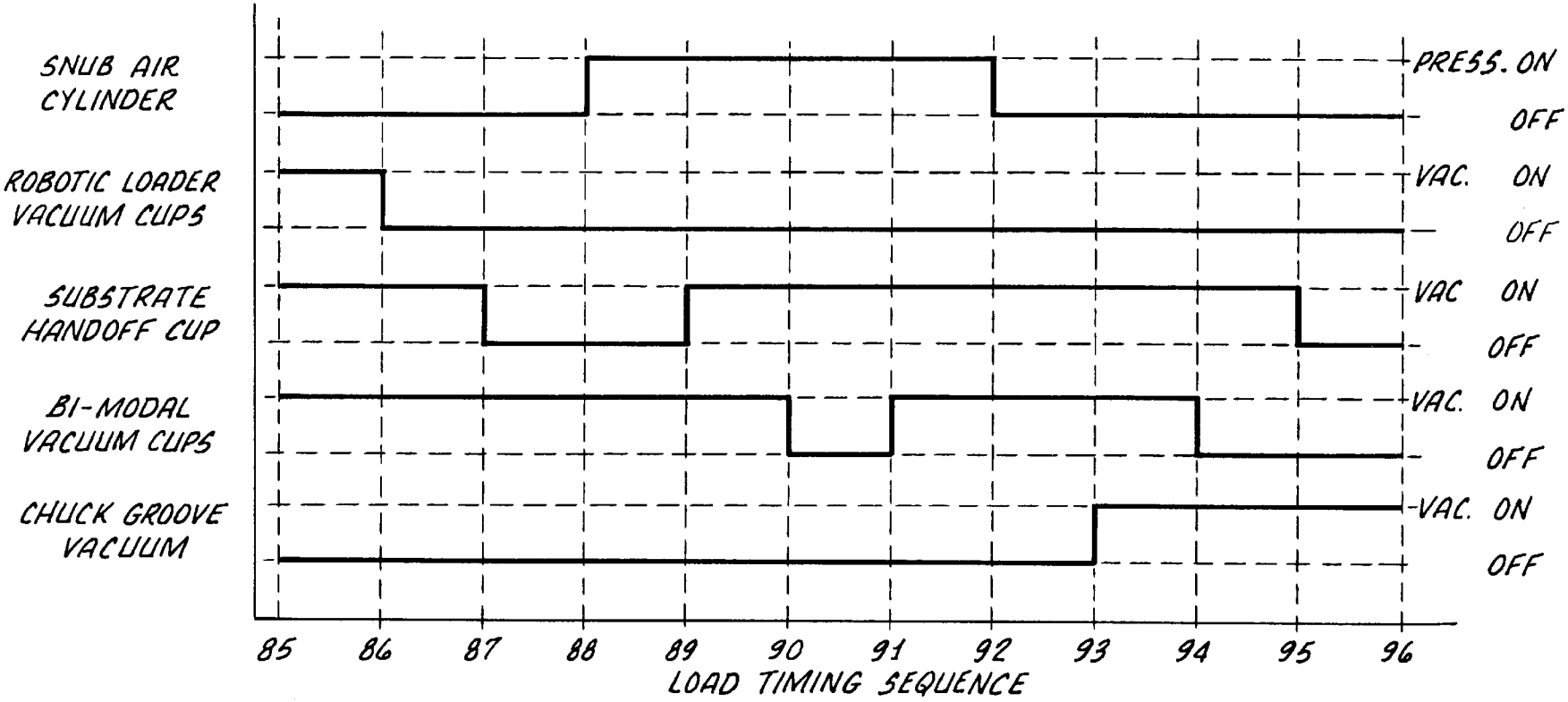
FIG. 12 is a diagram of the load timing sequence.

Referring next to FIG. 12, this shows the timing sequence of a single loading of a panel or other substrate onto the vacuum chuck 10. Referring to the right portion of such diagram, each word "on" means that vacuum or pressure is being applied as described in the preceding paragraph. Each word "off" means that pressure is being vented, or vacuum is being released by introduction of ambient air.

In the diagram of FIG. 12, the spaces between vertical lines 85–96 represent time, with the distance between each two adjacent lines representing about 9% of the time required by the present system (not including the end effector) for a loading cycle.

As indicated along lines 85 and 96, the valve positions are usually not the same at the beginning and end of the loading cycle. Most valve positions are reversed between loading cycles, typically (at least relative to chuck groove vacuum) after the photolithographic exposure has been made.

Figure 11:
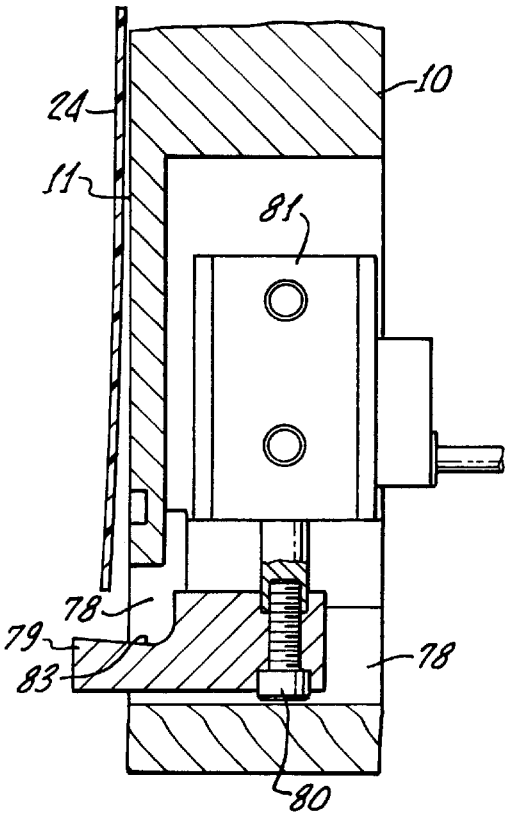
FIG. 11 is a fragmentary horizontal sectional view taken at line 11—11 of FIG. 1.

At the beginning of the loading cycle (line 85) the handoff and draw-down apparatus 25 (substrate handoff cup) is on, so that air is being sucked in through bore 47 (FIG. 4) but there is no retraction. The retractile draw-down apparatuses 27 (by-modal vacuum cups) are on, the vacuum having been applied when no panel or other substrate 24 was present. Accordingly, each combination vacuum cup-bellows is in the fully retracted condition shown in FIG. 6. The vacuum to chuck grooves 14 is off, as is the snub air cylinder 81 so that bar 79 is in its outer position (FIG. 11 but with no panel present).

There is a conventional robotic loader adapted to retrieve a panel 24 or other substrate from a cassette or other location and orient the panel for insertion into the photolithography apparatus of which the present system is a part. The robotic loader incorporates the above-indicated end effector having vacuum cups that are on when such retrieval occurs, and at the beginning of the present loading cycle, as indicated at line 85. The end effector goes into grooves 12, 13 (FIGS. 1 and 2). The loader brings the panel to a position adjacent the handoff and draw-down apparatus 25, the latter awaiting the placement of a panel in front of it. As soon as the robotic loader places the panel into such close proximity, the combination vacuum cup-bellows 29 (FIG. 4) grabs the panel.

This trips a vacuum-operated switch (not shown) associated with the line (bore) 35 leading to the handoff apparatus, and this switch causes the robotic loader to be instructed to release its vacuum cups. Physical control of the panel is thus transferred to the vacuum cup-bellows 29 which pulls the central region of the panel back to the surface 11 of vacuum chuck 10. Other portions of the panel may then also be near surface 11, but many are not due to the warped condition of the panel. The release of the vacuum to the vacuum cups of the robotic loader is indicated at line 86 in FIG. 12.

As the next step in the loading cycle, indicated at line 87 in FIG. 12, the vacuum to the vacuum cup-bellows 29 is released, permitting the panel 24 to drop by gravity onto the pin devices 61, 62 (FIG. 1). During such dropping, which is only for a small distance, the various vacuum cup-bellows devices in the retractile draw-down apparatuses 27 are not a factor because they are retracted below chuck surface 11 (FIG. 6). The vacuum cup-bellows device 29 of the handoff apparatus 25 also does not interfere with such dropping because of the low-friction (lubricious) nature of cover 39 (FIG. 4).

As indicated at line 88 in FIG. 12, air pressure is then applied to air cylinder 81 (FIG. 11) so that bar 79 is retracted and its face 83 engages the edge of panel 24 and moves the panel 24 horizontally until pin device 63 (FIG. 1) is engaged. Sleeves 68 roll freely with this shifting, so that they present very low friction to the panel edge. Furthermore, the cover 39 of the handoff apparatus much reduces friction (as above stated) and also prevents rolling of the edge of vacuum cup-bellows 29.

The pressure that continues to be applied by the snub bar 79 causes application of pressure at the sleeve 68 of each pin device 61, 62 and 63 (in addition to the gravitational force present at pin devices 61, 62). This eliminates play or backlash at such devices 61–63, and increases the degree of accuracy of location of the panel 24.

Referring to line 89, FIG. 12, vacuum is applied to the handoff and draw-down apparatus 25 (substrate handoff cup) to make sure that the panel 24 is in fact present and is, at least in its central part, adjacent surface 11 of chuck 10. This condition is sensed by the above-indicated vacuum switch, which stops the cycle in the event that the panel is not in fact approximately in the correct position. Normally, the cycle is not stopped, and apparatus 25 pulls the panel against surface 11.

Referring next to line 90 in diagram FIG. 12, the vacuum to the various vacuum cup-bellows devices 29*a* in the retractile apparatuses 27 is released so as to vent them and permit the upper edges of such devices to engage the inner side of panel 24, as shown in FIG. 7. Then, the vacuum is reapplied (line 91) so that such devices grab the underside of panel 24 and pull it back onto surface 11, as shown in FIG. 8. Accordingly, and despite the warped condition of the panel, substantially the entire peripheral—and central regions of the panel are caused to be in flatwise engagement with surface 11.

During the inward movement of the vacuum cup-bellows elements 29*a*, the sleeves 68 of the registration pin devices 61–63 move inwardly despite the light pressure of springs 74, as above described.

It is emphasized that, starting at line 91, both the handoff apparatus 25 and the retractile draw-down apparatuses 27 are on and are operative to maintain the panel adjacent chuck surface 11. Then, as indicated at line 92, the air cylinder 81 (FIG. 11) is turned off so that its spring moves bar 79 and face 83 away from the panel 24. The panel 24 does not move when bar 79 thus retracts, because it is held against surface 11 by the combined operation of all of the vacuum cup-bellows apparatuses 25, 27.

Thereafter, as indicated at line 93 in FIG. 12, the appropriate valve in valve elements 18 (FIG. 3) is operated to supply vacuum from vacuum source 16 to the vacuum grooves 14 (FIG. 1). If any part of the panel is not then engaged with the surface 11, it becomes thus engaged due to operation of the vacuum grooves 14. Such grooves operate effectively, without need for large amounts of suction, because the panel 24 is close to surface 11 and there is only small leakage between the panel and such surface. A vacuum switch (not shown) provides confirmation of this vacuum.

As indicated at lines 94,95 in FIG. 12, the application of vacuum to handoff apparatus 25 (substrate handoff cup) and retractile apparatus 27 (bi-modal vacuum cups) is discontinued. The purpose is to release any "dimpling", in the thin panel, that might have been caused by the suction in the various vacuum cup-bellows.

The panel 24 is now fully loaded into the photolithography apparatus, and an exposure is made by such apparatus (for example, as described in the cited patent).

After the exposure, the vacuum to grooves 14 is released, and the appropriate end effector is employed in association with grooves 12, 13 (FIGS. 1 and 2) to remove the panel from the apparatus.

By using only on-off control valves in the preferred embodiment, as automatically operated by the valve control 19 (FIG. 3) in the preferred embodiment, the loading cycle is caused to occur and be completed in a period of only several seconds after the robotic loader has released the panel (line 86 in FIG. 2). A much longer time is required for the robotic loading and for unloading.

The described loading cycle is not only fast, but very high precision, and positions the panel or other substrate very accurately.

Specific Example: diameter and length of orifice 55: 0.020 inch by 0.100 inch; vacuum (inches of mercury) present at vacuum source 16: 25; diameter of the passage 56 in pin 33*a*: 0.125 inch; diameter of passage 51: 0.125 inch.

The foregoing detailed description is to be clearly understood as given by way of illustration and example only, the spirit and scope of this invention being limited solely by the appended claims.

What is claimed is:

1. Apparatus for handling and holding flat panels and other flat substrates for photolithographic exposure, comprising:

(a) a chuck having a flat chuck surface adapted to support a substrate that is generally parallel to said chuck surface, (b) retractile draw-down apparatus mounted on said chuck to draw said substrate to said chuck surface, said draw-down apparatus comprising a draw-down element disposed below said flat chuck surface of said chuck, said draw-down apparatus further comprising means for causing said draw-down element to extend outwardly above said flat chuck surface to engage the surface of said substrate that is nearest said chuck surface, and to clamp onto said nearest surface, and to retract and pull said substrate into engagement with said chuck surface, (c) means to release said nearest surface from said draw-down element, and (d) whereby the chuck further incorporates means additional to said draw-down apparatus to hold said substrate against said chuck surface.

2. The apparatus as claimed in claim 1, in which means are provided to move said substrate in at least one direction parallel to said chuck surface, to bring said substrate to a predetermined registration position on said chuck surface for a photolithographic exposure.

3. Apparatus for snubbing flat panels and other flat substrates into a precisely predetermined position in a photolithography system, said apparatus comprising:

(a) a chuck having a flat chuck surface adapted to support a substrate that is generally parallel to said chuck surface, (b) snubbing means to move said substrate in a direction parallel to said chuck surface while said substrate is parallel to and near said chuck surface, and (c) registration pin devices mounted adjacent said chuck surface for engagement by edge portions of said substrate when said substrate is moved by said snubbing means parallel to said chuck surface and toward at least one of said registration pin devices, each of said registration pin devices comprising a shaft mounted on said chuck transverse to said chuck surface, and extending outwardly, and further comprising a sleeve provided coaxially on said shaft and adapted to be engaged by edge portions of said substrate, said registration pin devices being such that said sleeve may rotate freely relative to the axis of said shaft, in which each of said registration pin devices is so constructed that said sleeve may move transversely of said chuck surface, and in which means are provided to bias said sleeve in an outward direction relative to said chuck surface, said last-named means being sufficiently light that said edge portions may pull said sleeve toward said chuck surface.

4. Apparatus for snubbing a flat panel and other flat substrates into a precisely predetermined position in a photolithography system, said apparatus comprising:

(a) a chuck having a flat chuck surface, (b) snubbing means to move a flat substrate in a direction parallel to said chuck surface while said substrate is parallel to and near said chuck surface, and (c) registration pin devices mounted adjacent said chuck surface for engagement by edge portions of said substrate when said substrate is moved by said snubbing means parallel to said chuck surface and toward at least one of said registration pin devices, each of said registration pin devices comprising a shaft mounted on said chuck transverse to said chuck surface, and extending outwardly, and further comprising a sleeve on said shaft and adapted to be engaged by edge portions of said substrate, each of said registration pin devices being so constructed that said sleeve may move transversely to said chuck surface, each of said registration pin devices further comprising means to bias said sleeve in an outward direction relative to said chuck surface, said last-named means being sufficiently light that an edge portion of said substrate may pull said sleeve toward said chuck surface.

5. The apparatus as claimed in claim 4, in which said sleeve is freely rotatable relative to said shaft.

6. Apparatus for handling flat panels and other flat substrates prior to photolithographic exposure, which comprises:

(a) a vacuum chuck having a flat surface containing vacuum grooves adapted to support a flat substrate having an inner surface upon application of vacuum to said vacuum grooves to maintain against said flat surface said inner surface of said flat substrate, said chuck having a recess therein at said flat surface, (b) a vacuum device mounted in said recess, said vacuum device having a hard portion relatively adjacent said inner surface of said flat substrate and adapted to engage said inner surface and to vacuum-clamp thereto upon application of vacuum to said vacuum device, and (c) means to apply vacuum to said vacuum device and to release said vacuum therefrom, and characterized in that said hard portion, upon said release of vacuum from said vacuum device, permits said inner surface and thus said substrate to slide laterally over said vacuum device with low friction.

7. The apparatus as claimed in claim 6, in which said vacuum device is a vacuum cup-bellows, and in which said hard portion is a hard element mounted over the vacuum cup portion of said vacuum cup-bellows, and in which there is opening means in said hard element.

8. The apparatus as claimed in claim 7, in which said opening means is a hole means sufficiently large that said hard element will not be drawn inwardly upon said application of vacuum unless said inner surface of said substrate is adjacent said hard element.

9. Apparatus for handling and holding warped flat panels and other flat substrates for photolithographic exposure, comprising:

(a) a vacuum chuck having a flat outer surface, said surface having vacuum grooves therein for holding a substrate having an inner surface against said flat outer surface of said vacuum chuck, and (b) a plurality of vacuum cup-bellows devices provided adjacent said flat outer surface, each of said vacuum cup-bellows devices having an inner bellows portion and an outer vacuum cup portion;

said vacuum cup portion having an outer lip adapted to engage and clamp onto the inner surface of said substrate, and (c) means to apply vacuum to said vacuum grooves and to said vacuum cup-bellows devices.

10. The apparatus as claimed in claim 9, in which said chuck is so mounted that said flat surface thereof is at a large angle to horizontal.

11. The apparatus as claimed in claim 9, in which at least one of said vacuum cup-bellows devices has orifice means to restrict inward flow of air from the ambient atmosphere in response to application of vacuum to said one vacuum cup-bellows device by said vacuum means (c), said orifice means and the amount and rate of applied vacuum being such that said application of vacuum collapses said one vacuum cup-bellows device and thus retracts said outer vacuum cup portion thereof, at least one of said vacuum cup-bellows devices having a hard cover material provided over said vacuum cup portion thereof, said hard cover material reducing friction and preventing rolling of the edge of said vacuum cup portion.

12. The apparatus as claimed in claim 9, in which at least one of said vacuum cup-bellows devices has orifice means to restrict inward flow of air from the ambient atmosphere in response to application of vacuum to said one vacuum cup-bellows device by said vacuum means (c), said orifice means and the amount and rate of applied vacuum being such that said application of vacuum collapses said one vacuum cup-bellows device and thus retracts said outer vacuum cup portion thereof.

13. The apparatus as claimed in claim 12, in which said one vacuum cup-bellows device is mounted in a recess in said flat surface of said chuck, in such relationship that when said one vacuum cup-bellows device is thus collapsed by application of vacuum, said vacuum cup portion thereof is disposed inwardly of the plane of said flat surface of said chuck, and also in such relationship that upon cessation of application of vacuum to said one vacuum cup-bellows device said device expands and causes said vacuum cup portion to move outwardly to above said plane.

14. The apparatus as claimed in claim 13, in which means are provided to vent said recess to the ambient atmosphere independently of said flat surface.

15. The apparatus as claimed in claim 9, in which at least one of said vacuum cup-bellows devices has a hard cover material provided over said vacuum cup portion thereof, said hard cover material reducing friction and preventing rolling of the edge of said vacuum cup portion.

16. The apparatus as claimed in claim 9, in which registration pin devices are mounted on said vacuum chuck to accurately position each substrate for a photolithographic exposure, and in which means are provided to move said substrate substantially parallel to said flat outer surface of said chuck and into engagement with said registration pin devices.

17. The apparatus as claimed in claim 16, in which each of said registration pin devices is a sleeve mounted on a shaft for both rotational and longitudinal motion thereon.

18. The apparatus as claimed in claim 9, in which said vacuum chuck is so mounted that said flat surface thereof is at a large angle to horizontal.

19. A method of positioning and holding warped flat panels and other flat substrates for photolithographic exposure, which comprises:

(a) providing a chuck having a flat surface, and having vacuum grooves therein, (b) moving a flat substrate to a position adjacent said flat surface, and generally parallel thereto, (c) causing a vacuum device to vacuum grip onto the side of said substrate that is adjacent said flat surface, independently of said vacuum grooves, (d) causing said vacuum device to pull said substrate toward said flat surface, and (e) applying vacuum to said vacuum grooves.

20. A method of either (1) gripping and pulling a flat substrate in a photolithography apparatus, or (2) maintaining a vacuum gripper in a retracted condition in said apparatus where engagement with said flat substrate cannot occur, said method comprising:

(a) providing a vacuum device having a collapsible portion and a vacuum cup portion, wherein said vacuum device has a first predetermined size and said collapsible portion has a second predetermined size, (b) providing an orifice between said collapsible portion and said vacuum cup portion, (c) providing a chuck having a flat surface, and having a recess in said surface, (d) disposing said vacuum device in said recess, with said collapsible portion relatively far from said flat surface of said chuck, (e) correlating the first predetermined size of said vacuum device and the second predetermined size of said collapsible portion of said vacuum device in said recess in such manner that when said collapsible portion is in collapsed condition said vacuum cup portion is retracted into said recess, and when said collapsible portion is not in collapsed condition said vacuum cup portion is extended sufficiently far to engage a warped flat substrate that is disposed near said chuck adjacent said flat surface, (f) applying sufficient vacuum to said collapsible portion at a rate sufficiently great that said vacuum is not satisfied by flow of ambient air through said orifice into said collapsible portion from said vacuum cup portion, thereby causing said bellows portion to assume said collapsed condition so that said vacuum cup portion is retracted into said recess, (g) reducing said vacuum and permitting said collapsible portion to extend adjacent said substrate, and (h) employing said vacuum to cause said vacuum cup portion to grip onto said substrate, and cause said collapsible portion to collapse and pull on said vacuum cup portion and thus on said substrate, to pull said substrate against said flat surface.

21. The apparatus as claimed in claim 20, in which said method further comprises moving said substrate in a direction generally parallel to said flat surface, while said vacuum device is in its condition resulting from said step (f).

22. The apparatus as claimed in claim 21, in which said method further comprises providing registration pin devices adjacent said flat surface, and effecting said movement of said substrate into engagement with said registration pin devices.

* * * * *